United States Patent [19]

Kresta et al.

[11] Patent Number: 4,828,097

[45] Date of Patent: May 9, 1989

[54] TRIPLE PRICE SETTER FOR TOTALIZER COIN MECHANISM

[75] Inventors: Harvey Kresta, Hallettsville; Ralph J. Ullmann, Shiner, both of Tex.

[73] Assignee: Kaspar Wire Works, Inc., Shiner, Tex.

[21] Appl. No.: 154,870

[22] Filed: Feb. 11, 1988

[51] Int. Cl.[4] ..... G07D 5/08; G07F 5/08

[52] U.S. Cl. ..... 194/227; 194/322

[58] Field of Search ..... 194/226, 227, 223, 322

[56] References Cited

U.S. PATENT DOCUMENTS

| | | | |
|---|---|---|---|
| 2,991,867 | 7/1961 | Schuller | 194/226 |
| 3,028,940 | 4/1962 | Holstein et al. | 194/226 |
| 3,722,649 | 3/1973 | Pfitzer et al. | 194/223 |
| 3,792,766 | 2/1974 | Fougere | 194/322 |
| 4,037,701 | 1/1971 | Knickerbocker | 194/227 |
| 4,747,478 | 5/1988 | Friedman et al. | 194/227 |

*Primary Examiner*—F. J. Bartuska

*Attorney, Agent, or Firm*—Gunn, Lee & Jackson

[57] ABSTRACT

A coin control mechanism for use with a dispensing machine and containing a three-way adjustable price setter and a mechanical linkage to quickly change the coin control mechanism among any one of three preset prices, thus allowing for different price settings on different days. Three adjustable legs control the preinsertion position of a totalizer which calculates the cumulative total of coins inserted into the coin chute of the coin control mechanism. A three-position keyway and linkage allows an operator to quickly change the preinsertion position of the totalizer from outside of the coin control mechanism.

15 Claims, 2 Drawing Sheets

TRIPLE PRICE SETTER FOR TOTALIZER COIN MECHANISM

BACKGROUND OF THE INVENTION

1. Field of the Invention

A coin control mechanism for use in combination with a dispensing device. The mechanism includes a totalizer having three possible positions to allow the dispensing device to open when any one of three different cumulative values of coins are inserted therein.

2. Description of the Prior Art

The specifications and drawings of U.S. Pat. No. 4,037,701 ('701) are incorporated herein by reference, including the description of the prior art therein.

SUMMARY OF THE INVENTION

It is an object of this invention to allow for three different price combinations to be quickly and easily changed from outside the coin control mechanism. The coin control mechanism includes three adjustable price setters to allow for coins of a variety of denominations to actuate a release mechanism when any one of three preset denomination totals are inserted into the mechanism.

It is a further object of this invention to provide a bypass that allows a third price setting between a high price setting and a low price setting on a totalizer means to calculate the cumulative total of coins inserted into the coin control mechanism.

It is a further object of this invention to provide a slug rejecter means that will intercept a ferromagnetic slug before such slug reaches the totalizer means.

The specifications and drawings of the '701 patent are incorporated herein by reference, with the part numbers and terminology of that application carried into this application's specifications and drawings for clarity and ease of understanding. Structure that is added to the '701 patent begins with number four hundred and is even numbered. Structure that is inherent or disclosed in the '701 patent but not numbered therein but numbered in this application will start with number four hundred and one and be odd numbered.

The '701 patent discloses coin control mechanism 52 which comprises a totalizer means and a coin chute means arranged so that as coins pass through the coin chute means they activate the totalizer means to advance it in response to the denomination of the coin. For example, a quarter will advance the totalizer means more than a nickel. The locking means of the dispensing device is released on the registering of a predetermined price total on the totalizer means.

The latch control means of the '701 patent controls release of the access door. An adjustable price setter means sets the price or value of the coins necessary to operate the coin control mechanism at a predetermined price setting.

The adjustable price setter means of the '701 patent comprises an adjustable limit means to permit rapid changing of the price selected between an upper and a lower limit by the vendor. This is particularly useful in the case of newspaper vending machines because the price may vary between a daily edition to the Sunday paper.

DETAILED DESCRIPTION OF THE PREFERRED EMBODIMENT

Figure 1A:
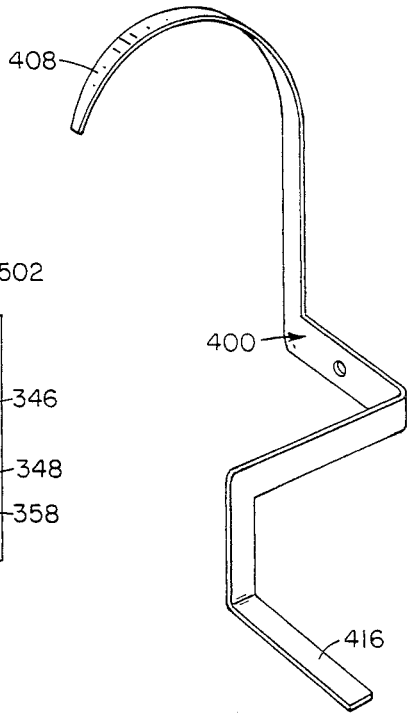
FIG. 1A is a perspective of the bypass removed from the coin control mechanism.

Structurally, this invention adds to the '701 patent bypass 400, illustrated in FIG. 1A apart from coin control mechanism 52. The function of bypass 400 is to permit a third price setting limit means for coin control mechanism 52. Frequently, periodical dispensing device 10 will carry papers of different prices at different times. For example, the daily edition of a newspaper may be one price, the Saturday edition a second price, and the Sunday edition, "Special" or "Extra" editions a third price. By using bypass 400 and the structure operatively associated therewith, as more fully set forth below, three different price setting limits are available to the vendor.

Bypass 400 is illustrated in FIG. 1A. It includes interact member 416 and curved portion 408. The paragraphs below will set forth additional structure and the general mode of operation. The section entitled "Operation of Bypass" will specifically describe its function.

The position of bypass 400 and its structural relationship to other elements is shown in FIGS. 1, 3, 4, 5A, 5B, and 5C. Spring 402 biases interact member 416 of bypass 400 against linkage 282. Price setter control means 48 is connected to linkage 282. Bypass 400 is actuated by rotating key means in price setter control means 48, causing rotation of linkage 282. This interaction between linkage 282 and bypass 400 is more clearly set forth in FIGS. 4, 5A, 5B and 5C. This rotation of linkage 282 by rotation of the key in price setter control means 48 will cause bypass 400 to pivot on pin 404.

Figure 4:
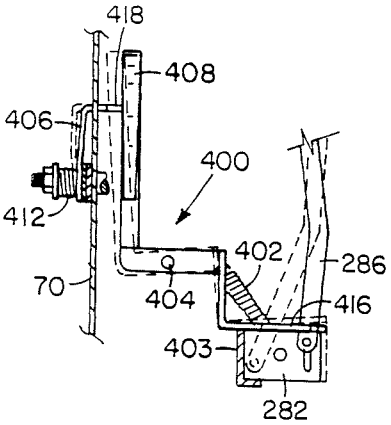
FIG. 4 is a side view of the bypass within the coin control mechanism.
Figure 3:
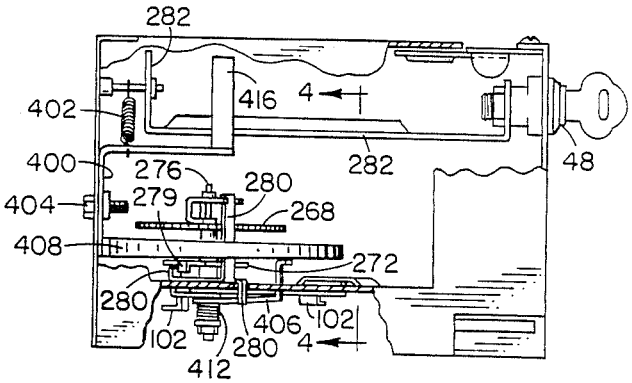
FIG. 3 is a partial cutaway of the top view of the coin control mechanism.
Figure 1:
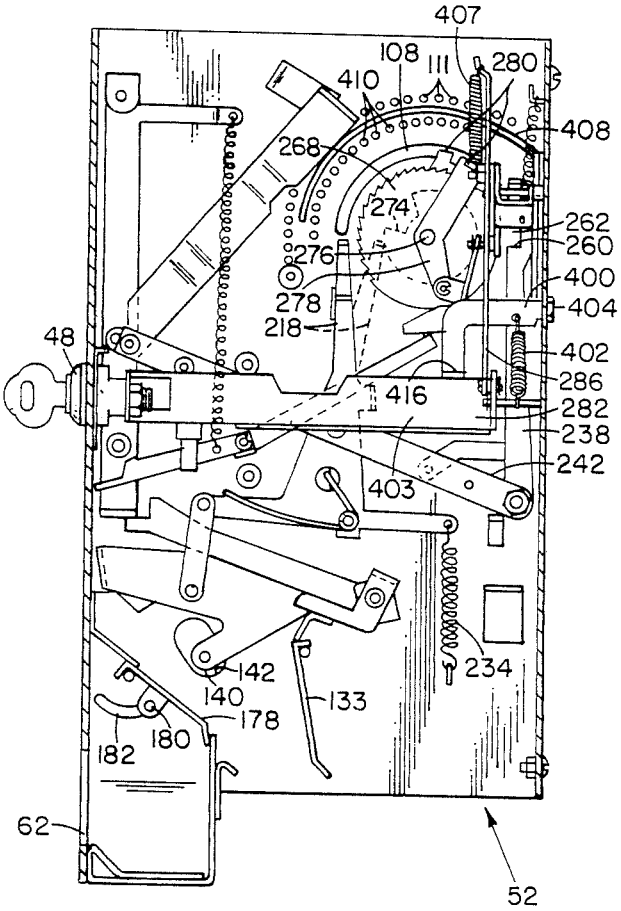
FIG. 1 is a side view of the coin control mechanism with the coin chute means removed.
Figure 2:
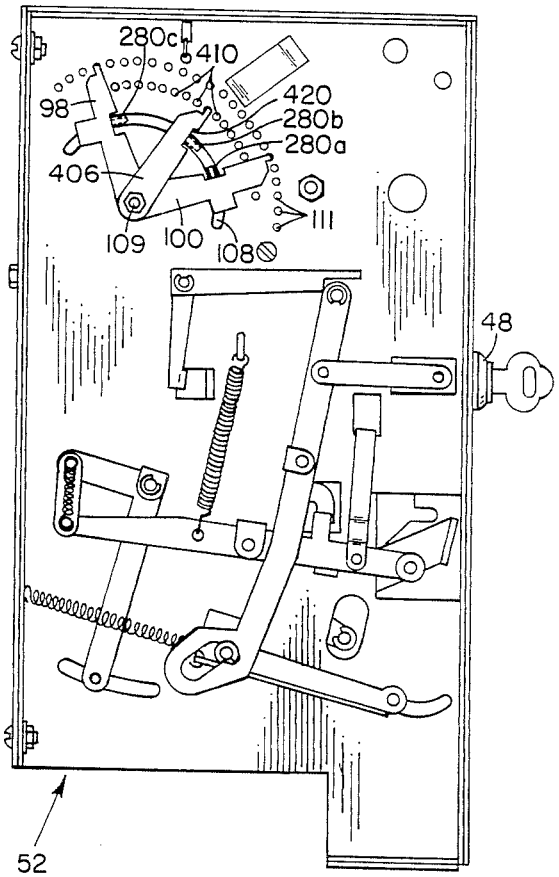
FIG. 2 is a side view of the coin control mechanism.

Generally, this pivoting of bypass 400 raises and lowers adjustable limit means 406 where it contacts curved portion 408 of bypass 400. FIG. 3 illustrates the location of spring 412 that biases adjustable limit means 406 towards a lowered position through apertures 410 and against curved portion 408. As can be seen in FIG. 4, prong 418 of adjustable limit means 406 passes slidably through plate 70 at apertures 410 therein, in much the same manner as adjustable limit means 98 and 100 pass through apertures 111 of the '701 mechanism. A series of apertures 410 is seen in FIG. 2. Adjustable limit means 406 may be manually raised so prong 418 is withdrawn from one aperture 410 and reinserted into a different aperture 410. This change would change the total denomination of coins required to activate coin oontrol mechanism 52, in the same manner that a change in position of limit means 98 or 100 as disclosed in the '701 patent effects such a change.

OPERATION OF BYPASS

Bypass 400 operates in the following manner. Price setter control means 48 may be rotated to one of three positions by use of the key means. Each of the three positions corresponds to one of three different price settings as determined by the position of adjustable limit means 98 and 100 in apertures 111 and adjustable limit means 406 in apertures 410. These three different positions are illustrated in FIG. 2 as 280*a*, 280*b* and 280*c*. Rotation of price setter control means 48 causes linkage 282 to rotate which in turn moves limit stop 280 to one of the three positions set by limit means 98, 100, and 406 illustrated in FIG. 2 as 280*a*, 280*b* and 280*c*. Each of these positions corresponds to a different position of totalizer register means 268. For example, position 280*a*, 280*b* and 280*c* may correspond to $0.50, $1.00, and $1.25, respectively, in total coinage required to activate coin control mechanism.

FIG. 2 illustrates the positional relationship of limit means 98, 100 and 406. To describe such positions, limit means 98 will alternately be referred to as upper limit means 98, as its position determines, denominationally, the greatest total coinage required to activate coin control mechanism 52. Limit means 100 will alternately be referred to as lower limit means 100, as its position determines, denominationally, the lowest coinage required to activate coin control mechanism 52. Limit means 406 will alternately be referred to as middle limit means 406 as its position determines, denominationally, the coinage required to activate coin control mechanism 52 when such coinage is intermediate between the upper and lower coinage totals.

Middle limit means 406 may be set in any of the stop positions determined by apertures 410, as long as such a stop position is between the position of upper limit means 98 and lower limit means 100.

The positions of limit stop 280, denoted 280*a*, 280*b* and 280*c* in FIG. 2, correspond to (arbitrarily) a 0°, 90° and 180° position of the key means which operates price setter control means 48. The corresponding position of bypass 400, middle limit means 406 and linkage 282 corresponding to each position of limit stop 280 shown in FIG. 2 as 280*a*, 280*b* and 280*c* is illustrated in FIGS. 5A, 5B and 5C, respectively.

Linkage 282 may be rotated to one of three positions by the key means attached to price setter control means 48. Linkage 282 has wall member 403 and articulates at pin 405. The three different positions of the key means correspond to FIGS. 5A, 5B, and 5C, each figure illustrating the corresponding position of linkage 282 and integral wall member 403. For the sake of illustration, the position indicated 280*a* will correspond to a 0° position of key means. In this position bypass spring 402 is "loaded" and biasing interact member 416 of bypass 400 against wall member 403 of linkage 282 as illustrated in FIG. 5A. In this position, limit means 406 is elevated sufficiently to allow limit stop 280 to pass beneath it. Position 280*a* reflects the position of totalizer register means 268, which position determines how far totalizer means must rotate before disengaging the locking means of the dispenser and thereby allowing access to the dispenser.

Figure 5B:
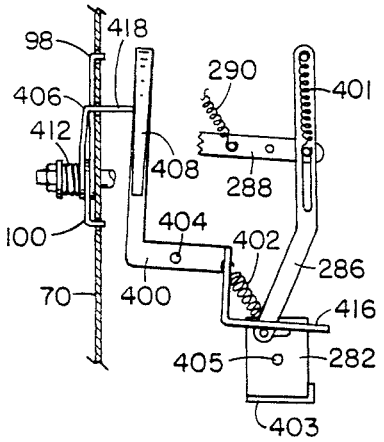
FIGS. 5A, 5B and 5C are a front side view with the front plate of the coin control mechanism removed, illustrating the three positions of the bypass and associated structure.
Figure 6:
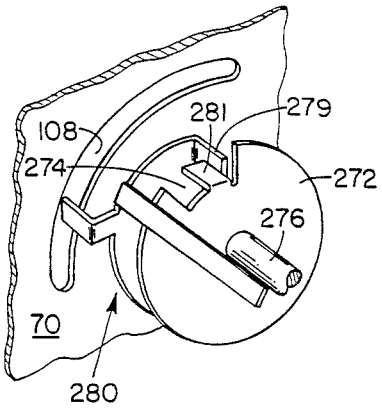
FIG. 6 is a perspective view from within the coin control mechanism of the limit stop.
Figure 5C:
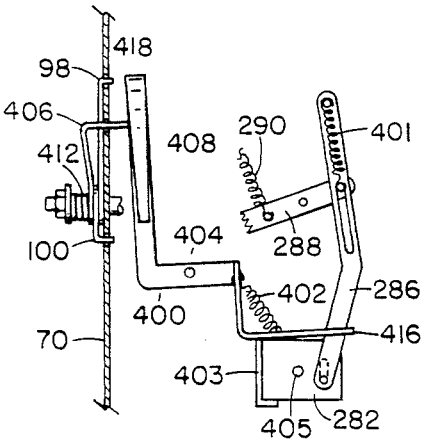
Figure 5A:
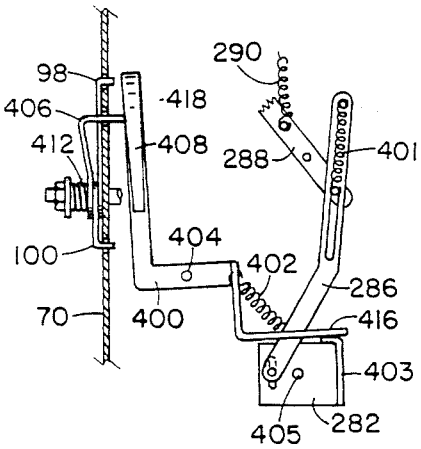

The rotation of the key means from 0° to 90° results in position of limit stop 280 as set forth in FIG. 2 as 280*b* and FIG. 5B. When the position of bypass 400 is in the position as illustrated in FIG. 5B, limit means 406 is urged against curved portion 408 by spring 412, allowing limit means 406 to move to its lowered position from its elevated position. Limit means 406 catches limit stop 280 in notch 420, as limit stop 280 moves toward limit means 98 under the urging of the key means against spring 290 (which normally maintains limit stop 280 at position 280*a*). Limit means 406 catches limit stop 280 before the key means and linkage 282 reaches 90°. The key means must be turned with greater torque after the catch as linkage 288 is stationary (because limit stop 280 is stationary against limit means 406) and the continued rotation of the key means up to the 90° position forces an extension of spring 401. At the 90° position, limit stop 280 is being urged against limit means 406 by spring 401. Simultaneous with the rotation from 0° to 90°, wheels 268 and 272 (which are biased to rotate around stud 276) "follow" limit stop 280. Wheels 268 and 272 move as a unit and are biased, pressing limit plate 281 which is integral with wheel 272 against stop tab 279 projecting from and integral with limit stop 280, as seen in FIG. 6. In other words, as the key is rotated from 0° to 90°, three actions are taking place: limit means 406 is lowering and getting closer to plate 70 at the same time that limit stop 280 is rotating towards limit means 406, and such rotation is allowing wheels 268 and 272 of totalizer register means 268 to "follow along," or rotate therewith.

After the key means is rotated from a 0° (280*a*) position to a 90° (280*b*) position, limit stop 280 has come to rest in notch 420 of middle limit means 406. The 90° position of linkage 282, interact member 416 and limit means 406 is as illustrated in FIG. 5B. Wheels 268 and 272 of totalizer register means 268 have "followed along" in the manner described above. An intermediate coinage total is now required to activate the dispenser and allow access to the periodicals contained therein.

When the key means is moved from the 90° position to the 180° position, limit stop 280 comes to a rest against limit means 98. Rotation of key to the 180° position moves limit stop 280 to the position indicated by 280*c* in FIG. 2. The movement of limit stop 280 to 280*c* is initiated and effected in the same manner and through the same linkage as the movement to position 280*b*. In this 180° position, the position of linkage 282, interact member 416 and limit means 406 is as illustrated in FIG. 5C, and limit means 406 is being held in an elevated position.

As can be seen in FIGS. 5A, 5B and 5C the raising and lowering of limit means 406 in response to the turning of the key means is sufficient to allow enough clearance for limit stop 280 to pass therebeneath when limit means 406 is in the raised position and is low enough to catch limit stop 280 when in its lowered position.

Furthermore, during the rotation from 90° to 180°, wheels 268 and 272 rotate in the same manner as set forth above. The rotation of limit stop 280 from 280*b* to position 280*c* occurs when linkage 286 shifts from the position as illustrated in FIG. 5B, where spring 401 is biasing limit stop 280 against limit stop means 406, to a position as illustrated in FIG. 5C where spring 401 is still biasing limit stop 280 in clockwise direction but limit stop is now flush against limit stop means 98. The raising of limit means 406 allows the movement of limit stop 280 thereunder and up to limit stop means 98. The force required to urge such biasing and maintain pressure originates at spring 401 and is transmitted through elements 288 and 278 to limit stop 280.

At the 180° position of the key means and linkages 282 and 296, limit stop 280 rests against limit stop means 98. The movement of wheels 268 and 272 of totalizer register means 268 has changed the position of notch portion 274 with respect to element 218. In other words, as the key means is rotated from 90° to 180°, three actions are taking place. Limit means 406 is raising, limit stop 280 is then released and moves towards limit means 98, while, simultaneously, wheels 268 and 272 are rotating and changing position of totalizer register means 268.

For limit stop 280 to return from 180° (280*c*) to 0° (280*a*), the key means is rotated back to the 0° position. This rotation results in the following actions. First, it allows limit means 406 to lower as wall member 403 rotates away from interact member 416 and permits springs 412 and 402 to compress. This catches limit stop 280 against the back side of limit means 406 (opposite notch 420). Then, as the 0° position is being approached, wall member 403 contacts interact member 416, rotates bypass 400 and raises limit means 406, allowing limit stop 280 to freely rotate back to the 0° (280*a*) position.

Thus, it is seen how the use of bypass 400, a three-position key means, limit means 406, and the related structure set forth herein allows a rapid change of the coin control mechanism to one of three different coin denominational totals to activate the dispenser.

Figure 7:
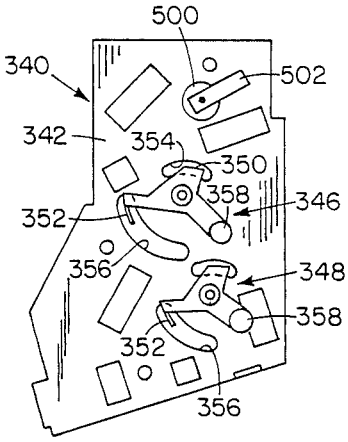
FIG. 7 is a left side view of the coin chute means mounting plate with the slug reject means mounted thereon.

A further improvement of coin control mechanism 52 is the addition of slug reject means 500 illustrated in FIG. 7. Slug reject means 500 is a ferromagnetic mass that is attached to coin control mechanism 52 adjacent to the coin chute means in order to intercept a ferromagnetic slug before such slug reaches the totalizer means. Slug reject means 500 may be mounted on and extend through plates 292, 294 or 342. In the preferred embodiment, slug reject means 500 is mounted on plate 342 by bracket 502. It passes through plates 342 and 292 so that a flat surface thereof lies in the plane of plate 392 facing the coin chute.

In operation, slug reject means 500 will magnetically intercept a ferromagnetic slug in the slug's passage through the coin chute. This will prevent the slug from activating the totalizer means, and will also jam the coin chute. However, depressing coin return actuator bar 64 will allow the slug to fall into coin return opening 62. This occurs because the depressing of coin return actuator bar 64 rotates plates 292 and 292 away from plate 342 (as set forth in the '701 patent) and therefore removes the slug from the grip of the magnetic field generated by slug reject means 500.

Although the invention has been described with reference to a specific embodiment, this description is not meant to be construed in a limiting sense. Various modifications of the disclosed embodiments will become apparent to those skilled in the art upon reference to the description of the invention. It is therefore contemplated that the appended claims will cover such modifications that fall within the true scope of the invention.

I claim:

1. A device accessible from the outside of a coin mechanism for quickly changing the activation value of said coin mechanism between resetable high, intermediate and low desired cumulated values of coins, the coin mechanism having a totalizer that cumulates the value of coins inserted into said coin mechanism the device comprising:

rotation means rotatable between a first angular position, a second angular position and a third angular position, said rotation means being accessible from the outside of said coin mechanism;

price control means comprised of an upper limit member, a middle limit member, a lower limit member, a pivot and a limit stop;

said upper limit member having a first end and a second end, said first end of said upper limit member being attached to said pivot and said second end of said upper limit member being moveable along an arc to between points corresponding to different possible high desired activation cumulated coin values;

said middle limit member having a first end and a second end, said first end of said middle limit member being attached to said pivot, and said second of end said middle limit member being moveable along an arc to points corresponding to different possible intermediate desired activation cumulated coin values;

said lower limit member having a first end and a second end, said first end of said lower limit member being attached to said pivot, said second end of said lower limit member being moveable along an arc to points corresponding to different possible low desired activation cumulated coin values;

said limit stop having a first end and a second end, said first end being connected to said pivot and said second end being moveable along an arc between said upper limit member and said lower limit member, the location of said second end being determinative of the activation value of said coin mechanism;

said upper limit member, said lower limit member and said limit stop being in the same plane so the movement of said second end of said limit stop is restricted to an arc between said upper limit member and said lower limit member;

linkage means connected to said rotational means and to said limit stop for communicating changes in the angular position of said rotational means to said limit stop so moving said rotational means to said first angular position causes said limit stop to move toward said lower limit member and moving said rotational means from said first angular position to said second angular position or to said third angular position causes said limit stop to move toward said upper limit member;

bypass means connected to said rotational means to cause said middle limit member to move into the path of said second end of said limit stop when said rotational means is rotated from said first angular position to said second angular position so said middle limit member stops the movement of said limit stop and to cause said middle limit member to not be in the path of said second end of said limit stop except when said rotational means is in said second angular position;

said device being useful for setting the activation value of said coin mechanism at a low desired cumulative value of coins when said rotational means is rotated to said first angular position to move said limit stop against said lower limit member, setting the activation value of said coin mechanism at a desired intermediate cumulative value of coins when said rotation means is rotated from said first angular position to said second angular position and said bypass means moves said middle limit member into the path of said limit stop and said limit stop is moved against said middle limit member, or setting the activation value of said coin mechanism at a high desired cumulative value of coins when said rotational means is rotated to said third angular position to move said limit stop against said upper limit member, all by rotating said rotation means between said three angular positions from the outside of said coin mechanism.

2. A coin control mechanism for use with a dispensing machine wherein the dispensing machine includes an access door to permit removal of articles from the dispensing machine an latch means attached to the access door to normally lock the access door in a closed position, the coin control mechanism having: a housing attached to the dispensing machine; coin chute means arranged within said housing to receive coins inserted into said housing; and an actuator means removably attached to said housing and disposed to lockingly engage the latch means when in a non-dispensing position and disengage the latch means when it is in a dispensing position, a totalizer means movable between a dispensing and a non-dispensing position, said actuator means movable from said non-dispensing to said dispensing position to operativley engage said totalizer means and disengage the latch means to unlock the access door when said totalizer means is in said dispensing position relative to said actuator means; the improvement comprising:

adjustable price setter means comprising a limit stop movable between an upper limit, middle limit and lower limit disposed to engage said totalizer means to control the movement thereof;

variable adjustment means mounted on said housing, said variable adjustment means including upper limit means, middle limit means and lower limit means, all movably mounted on said housing independently of each other to selectively vary the relative distance therebetween, said limit stop coupled to a price control means movable between a first position, a middle position, and a second position by a quick change adjustment means, said upper limit means, said middle limit means and said lower limit means disposed to engage said limit stop and thereby determine said upper limit, said middle limit and said lower limit, respectively;

said upper limit means and said lower limit means each comprise an adjustment leg pivotally mounted on said housing and postionable to any one of a plurality of stop positions;

said middle limit means comprises an adjustment leg pivotally mounted on said housing between said upper limit means and lower limit means, and positionable to anyone of a plurality of stop positions between said upper limit means and said lower limit means, wherein the stop position at which each of said upper limit means, said middle limit means and said lower limit means is positioned determines the cumulative coinage total required to disengage the latch means and allow access to the dispensing machine; and a bypass with a first end and a second end, said byapss being in operative association with said quick change adjustment means at said first end and in operative association with said middle limit means at said second end, for lowering said middle limit means when said price control means is moved form said first position to said middle position, thereby intercepting said limit stop at said middle limit, and subsequently raising said middle limit means when said price control means moved from said middle position to said second position, thereby allowing said limit stop to move to said upper limit;

wherein said bypass is further capable of allowing movement of said limit stop from said upper limit to said lower limit without interception by said middle limit means when said price control means is moved from said second position to said first position.

3. The coin control mechanism as described in claim 2 above further comprising:

biasing means for lowering said middle limit means.

4. The coin control mechanism as described in claim 2 above further comprising:

biasing means for urging said bypass against said quick change adjustment means.

5. The coin control mechanism as described in claim 2 further comprising a slug reject means disposed aside said coin chute means for intercepting ferromagnetic slugs during their passage through said coin chute means, said slug reject means including a permanent magnet.

6. The coin control mechanism as described in claim 5 wherein said slug reject means is movable mounted aside said coin chute means and capable of rotating away therefrom to drop the intercepted ferromagnetic slug into a coin return receptacle.

7. A coin control mechanism for use with a dispensing machine wherein the dispensing machine includes an access door to permit removal of articles from the dispensing machine and latch means attached to the access door to normally lock the access door in a closed position, the coin control mechanism having: a housing attached to the dispensing machine; coin chute means arranged within said housing to receive coins inserted into said housing; and an actuator means removably attached to said housing and disposed to lockingly engage the latch means when in a non-dispensing position and disengage the latch means when it is in a dispensing position, a totalizer means movable between a dispensing and a non-dispensing position, said actuator means movable from said non-dispensing to said dispensing position to operatively engage said totalizer means and disengage the latch means to unlock the access door when said totalizer means is in said dispensing position relative to said actuator means; the improvement comprising:

adjustable price setter means comprising a limit stop movable between an upper limit, middle limit and lower limit disposed to engage said totalizer means to control the movement thereof;

variable adjustment means mounted on said housing, said variable adjustment means including upper limit means, middle limit means and lower limit means, all movably mounted on said housing independently of each other to selectively vary the relative distance therebetween, wherein said upper limit means and said lower limit means each comprise an adjustment leg pivotally mounted on said housing and positionable to any one of a plurality of stop positions and said middle limit means comprises an adjustment leg pivotally mounted on said housing between said upper limit means and said lower limit means, and positionable to any one of a plurality of stop positions between said upper limit means and said lower limit means;

a price control means coupled to said limit stop, movable between a first position, a middle position, and a second position by a quick change adjustment means, said upper limit means, said middle limit means and said lower limit means disposed to engage said limit stop and thereby determine said upper limit, said middle limit and said lower limit;

a bypass with a first end and a second end, said bypass being in operative association with said quick change adjustment means at said first end and in operative association with said middle limit means at said second end, for lowering said middle limit means when said price control means is moved from said first position to said middle position, thereby intercepting said limit stop at said middle limit, and subsequently raising said middle limit means when said price control means is moved from said middle position to said second position, thereby allowing said limit stop to move to said upper limit, wherein said bypass is further capable of allowing movement of said limit stop from said upper limit to said lower limit without interception by said middle limit means when said price control means is moved from said second position to said first position;

biasing means for lowering said middle limit means; and biasing means for urging said bypass against said quick change adjustment means;

wherein the stop position at which each of said upper limit means, said middle limit means and said lower limit means is positioned to determine the cumulative coinage total required to disengage the latch means and allow access to the dispensing machine.

8. A coin mechanism for controlling access to a dispensing machine, said dispensing machine including access means and latch means for locking said access means in a closed position, said coin mechanism comprising:

coin chute means;

means for totalizing the value of coins dropped in said coin chute means;

actuator means operatively connected to said totalizing means for releasing said latch means when a predetermined value of coins has passed through said coin chute means;

means for selecting said predetermined value from an upper value, a middle value, and a lower value;

a limit stop movable between an upper limit member, a middle limit member and a lower limit member, corresponding to said upper value, said middle value and said lower value, respectively, said limit stop being connected to said totalizing means; and adjustment means for moving said limit stop to one of said limit members;

said adjustment means comprises a linkage member coupled to said limit stop, whereby rotation of said linkage member causes said limit stop to move between said limit members;

wherein said linkage member is further connected to lock means mounted on the outside of said dispensing machine, whereby movement of said lock means to a first angular position causes said limit stop to move to said upper limit member, movement of said lock means to a second angular position causes said limit stop to move to said middle limit member, and movement of said lock means to a third angular position causes said limit stop to move to said lower limit member, thus allowing quick adjustment in said coin mechanism between said upper, said middle and said lower values.

9. The coin mechanism of claim 8 wherein each of said limit members is pivotably mounted about a common pivot point, and said limit stop moves along an arc whose center of curvature lies approximately at said pivot point, such that each of said limit members may be selectively positioned, corresponding to changes in said upper value, said middle value and said lower value.

10. The coin mechanism of claim 8 wherein said adjustment means comprises a linkage member coupled to said limit stop, whereby rotation of said linkage member causes said limit stop to move between said limit members.

11. The coin mechanism of claim 9 wherein said adjustment means comprises a linkage member coupled to said limit stop, whereby rotation of said linkage member causes said limit stop to move between said limit members.

12. The coin mechanism of claim 10 wherein said linkage member is further connected to lock means mounted on the outside of said dispensing machine, whereby movement of said lock means to a first angular position causes said limit stop to move to said upper limit member, movement of said lock means to a second angular position causes said limit stop to move to said middle limit member, and movement of said lock means to a third angular position causes said limit stop to move to said lower limit member, thus allowing quick adjustment in said coin mechanism between said upper, said middle and said lower values.

13. A coin mechanism for controlling access to a dispensing machine, said dispensing machine including access means and latch means for locking said access means in a closed position, said coin mechanism comprising:

coin-chute means;

means for totalizing the value of coins dropped in said coin chute means;

actuator means operatively connected to said totalizing means for releasing said latch means when a predetermined value of coins has passed through said coin chute means;

means for selecting said predetermined value from an upper value, a middle value, and a lower value;

a limit stop movable between an upper limit member, a middle limit member and a lower limit member, corresponding to said upper value, said middle value and said lower value, respectively, said limit stop being connected to said totalizing means, wherein each of said limit members is pivotably mounted about a common pivot point, and said limit stop moves along an arc whose center of curvature lies approximately at said pivot point, such that each of said limit members may be selectively positioned, corresponding to changes in said upper value, said middle value and said lower value;

adjustment means for moving said limit stop to one of said limit members, said adjustment means comprises a linkage member coupled to said limit stop, whereby rotation of said linkage member causes said limit stop to move between said limit members;

wherein said linkage member is further connected to lock means on the outside of said dispensing machine, whereby movement of said lock means to a first angular position causes said limit stop to move to said upper limit member, movement of said lock means to a second angular position causes said limit stop to move to said middle limit member, and movement of said lock means to a third angular position causes said limit stop to move to said lower limit member, thus allowing quick adjustment in said coin mechanism between said upper, said middle and said lower values.

14. A coin mechanism for controlling access to a dispensing machine, said dispensing machine including access means and latch means for releasably locking said access means in a closed position, said coin mechanism comprising:

coin chute means;

means for totalizing the value of coins dropped in said coin chute means;

actuator means operatively connected to said totalizing means for releasing said latch means when a predetermined value of coins has passed through said coin chute means;

means for selecting said predetermined value from an upper value, a middle value, and a lower value;

a limit stop movable between an upper limit member, a middle limit member and a lower limit member, corresponding to said upper value, said middle value and said lower value, respectively, said limit stop being connected to said totalizing means, wherein each of said limit members is pivotably mounted about a common pivot point, such that each of said limit members may be selectively positioned, corresponding to changes in said upper value, said middle value and said lower value, said limit stop moveable along an arc whose center of curvature lies approximately at said pivot point;

adjustment means for moving said limit stop to one of said limit members, wherein said adjustment means comprises a linkage member coupled to said limit stop, whereby rotation of said linkage member causes said limit stop to move between said limit members, wherein said linkage member is further connected to lock means mounted on the outside of said dispensing machine, whereby movement of said lock means to a first angular position causes said limit stop to move to said upper limit member, movement of said lock means to a second angular position causes said limit stop to move to said middle limit member, and movement of said lock means to a third angular position causes said limit stop to move to said lower limit member, thus allowing quick adjustment in said coin mechanism between said upper, said middle and said lower values.

15. A coin control mechanism for use with a dispensing machine wherein the dispensing machine includes an access door to permit removal of articles from the dispensing machine and latch means attached to the access door to normally lock the access door in a closed position, the coin control mechanism having: a housing attached to the dispensing machine; coin chute means arranged within said housing to receive coins inserted into said housing; and an actuator means removably attached to said housing and disposed to lockingly engage the latch means when in a non-dispensing position and disengage the latch means when it is in a dispensing position, a totalizer means movable between a dispensing and a non-dispensing position, said actuator means movable from said non-dispensing to said dispensing position to operatively engage said totalizer means and disengage the latch means to unlock the access door when said totalizer means is in said dispensing position relative to said actuator means; the improvement comprising:

adjustable price setter means comprising a limit stop movable between an upper limit, middle limit and lower limit disposed to engage said totalizer means to control the movement thereof; and variable adjustment means mounted on said housing, said variable adjustment means including upper limit means, middle limit means and lower limit means, all movably mounted on said housing independently of each other to selectively vary the relative distance therebetween, said limit stop coupled to a price control means movable between a first position, a middle position, and a second position by a quick change adjustment means, said upper limit means, said middle limit means and said lower limit means disposed to engage said limit stop and thereby determine said upper limit, said middle limit and said lower limit, respectively; and a bypass with a first end and a second end, said bypass being in operative association with said quick change adjustment means at said first end and in operative association with said middle limit means at said second end, for lowering said middle limit means when said price control means is moved from said first position to said middle position, thereby intercepting said limit stop at said middle limit, and subsequently raising said middle limit means when said price control means is moved from said middle position to said second position, thereby allowing said limit stop to move to said upper limit;

wherein said bypass is further capable of allowing movement of said limit stop from said upper limit to said lower limit without interception by said middle limit means when said price control means is moved from said second position to said first position.

* * * * *